United States Patent [19]

Numano et al.

[11] 4,452,061

[45] Jun. 5, 1984

[54] SEAMLESS STEEL PIPE MANUFACTURING INSTALLATION

[75] Inventors: Masachika Numano, Yokosuka; Shinji Akita, Yokohama, both of Japan

[73] Assignee: Nippon Kokan Kabushiki Kaisha, Tokyo, Japan

[21] Appl. No.: 330,806

[22] Filed: Dec. 15, 1981

[30] Foreign Application Priority Data

| | | | |
|---|---|---|---|
| Dec. 16, 1980 | [JP] | Japan | 55-176536 |
| Dec. 19, 1980 | [JP] | Japan | 55-178813 |
| Dec. 20, 1980 | [JP] | Japan | 55-179721 |
| May 18, 1981 | [JP] | Japan | 56-74455 |

[51] Int. Cl.[3] ..... B21B 23/00

[52] U.S. Cl. ..... 72/201; 72/202; 72/206; 72/368

[58] Field of Search ..... 72/201, 202, 205, 206, 72/208, 226, 234, 368; 29/33 D; 198/774

[56] References Cited

U.S. PATENT DOCUMENTS

| | | | |
|---|---|---|---|
| 1,930,702 | 10/1933 | Webster | 29/33 D |
| 1,980,368 | 11/1934 | Bark et al. | 72/201 |
| 3,581,384 | 6/1971 | Peterson et al. | 29/527.7 |
| 3,815,726 | 6/1974 | Klein | 198/774 |

FOREIGN PATENT DOCUMENTS

| | | | |
|---|---|---|---|
| 428923 | 5/1974 | U.S.S.R. | 72/368 |

*Primary Examiner*—Lowell A. Larson

*Attorney, Agent, or Firm*—Fleit, Jacobson, Cohn & Price

[57] ABSTRACT

Disclosed is a high-efficiency manufacturing installation in which seamless steel pipe rolling and finishing lines are matched in capacity with each other and are formed into a single continuous lines.

The high-speed rolling line extends to a straightening machine via a cooling equipment for as-rolled pipes and a heat treating equipment for pipes to be heat-treated and is further connected to a single-line finishing line via a nondestructive inspection machine and a cutting machine. The finishing line comprises each plurality of different finishing machines arranged along a variable feed pitch transverse transfer line, the plural number being selected in correspondence to the capacity of the rolling line. The cooling equipment and the heat treating equipment are designed so that each of them requires the same transfer time and thus there is no danger of causing any blank in the feed pitch spacing during the change-over between the as-rolled pipes and the pipes to be heat-treated.

8 Claims, 5 Drawing Figures

SEAMLESS STEEL PIPE MANUFACTURING INSTALLATION

BACKGROUND OF THE INVENTION

The present invention relates to a seamless steel pipe manufacturing installation and more particularly to a seamless steel pipe manufacturing installation comprising a highly efficient line arrangement in which a rolling line and a finishing line are matched in capacity with each other and are operated as a continuous process line.

It is well known in the art that in the manufacture of seamless steel pipes by hot rolling, the pipes produced by the rolling line including piercing, rolling and sizing mills are divided into as-rolled pipes requiring no heat treatment and those to be heat-treated which require a special heat treatment. More specifically, the as-rolled pipes are transferred from the rolling line to a cooling equipment such as a cooling bed and the pipes to be heat-treated are transferred to a heat treating line including a heating furnace, quenching unit, reheating furnace, etc.

With the above-described line arrangement, not only a kick-out mechanism is required for each line but also a vast installation space is naturally required and the equipment layout also becomes complicated. For instance, in the manufacture of oil well pipes requiring mass handling, if the pipes to be heat-treated must be subjected to such a conditioning processing such as threading of the pipe ends after the heat treatment as in the case of the as-rolled pipes, it is necessary to transfer either the pipes to be heat-treated or the as-rolled pipes to a finishing equipment for thread cutting or the like if the line arrangement is such that the as-rolled pipes and the pipes to be heat-treated are transferred to the following processing equipment by way of separate lines as in the previously mentioned case. Even if the pipes are transferred to the finishing equipment, if the finishing equipment is in operation, the efficiency will be deteriorated by a delay due to the waiting time and the number of lines of the finishing equipment must be increased to increase the efficiency, thus making the entire arrangement extremely irrational and uneconomical.

On the other hand, while a great contribution will be made toward improving the efficiency if the equipment including from the rolling line to the finishing lines are combined as a series of consecutive units to form a continuous manufacturing installation, this involves a serious problem of relative balance of capacity between the rolling line and the finishing line. In other words, while various kinds of rolling processes such as the plug mill process, mandrel mill process, etc., are used in the manufacture of hot-finished seamless steel pipes by rolling process, with any of these processes there is an appreciable unbalance of capacity between the capacity of the rolling line and that of the following finishing line for pipe end processing or the like, that is, the capacity of the latter is inferior to that of the former so that even if the rolling line and the finishing line are connected as a single continuous process line, the rolled steel pipes must be temporarily piled for example at the terminal end of the rolling line which is before the finishing line and this gives rise to such problems as deterioration in the efficiency of the line on the whole and the requirement for a space occupied exclusively by the line. Moreover, it has been the practice so that where different finishing operations are required for different types of pipes to be produced, a multiple-exit line construction is employed to provide separate line exits for different kinds of pipes thus giving rise to such disadvantages as making the transfer patch construction of the finishing line complicated and requiring extra transfer time. Further, it has been undeniable that the finishing line comprises a hybrid arrangement of axial and transverse steel pipe transfer lines and thus there are very much wasteful transfer such as wasteful transfer of steel pipes and changes in the direction of transfer of pipes.

SUMMARY OF THE INVENTION

It is an object of the present invention to provide a seamless steel pipe manufacturing installation in which a rolling line and a finishing line are balanced in capacity with each other and the lines are formed into a single continuous line, thus giving full swing to the rolling efficiency to attain the desired high efficiency and also making it possible to produce both as-rolled pipes and pipes to be heat-treated with the same cycle by means of the single continuous line arrangement covering the operations including from the rolling to the finishing operations such as thread cutting, etc.

It is another object of the invention to provide a seamless steel pipe manufacturing installation which eliminates any duplicate equipment and requires a reduced occupied area.

Thus, in accordance with one form of the invention, a seamless steel pipe manufacturing installation is provided in which a rolling line including a piercer, an elongator, a multiple-stand continuous pipe rolling mill and a sizer which are arranged consecutively in this order, a cooling equipment whereby the rolled pipes fed axially thereinto from the rolling line are cooled while feeding them transversely, a straightener whereby the pipes passed from the cooling equipment are straightened while feeding them axially, an inspection machine for receiving the pipes from the straightener and nondestructively inspecting the pipes while feeding them axially and a cutting machine for cutting the pipes passed from the inspection machine are arranged consecutively in line with one another and in which a finishing line is proviced which includes a single-line variable feed pitch transverse transfer line connected to the exit end of the cutting machine and finishing machines including pipe end chamfering machines, pipe inner surface cleaners, pipe end threading machines, threads inspecting machines, threaded component fitting machines, drift power tighteners, hydrostatic testing machines, measuring and weighing machines, marking machines and coating machines which are arranged along the transverse transfer line each in plural number corresponding to the rolling capacity.

In accordance with another form of the invention, the cooling equipment is an equipment for as-rolled pipes and connected to and arranged parallel to the cooling equipment is a heat treating equipment for heat-treating the rolled pipes, whereby the required transfer time from the rolling line to the straightener is the same when the pipe is transferred via the cooling equipment and via the heat treating equipment, respectively.

Specifically, the cooling equipment comprises a transverse skid type cooling bed and the heat treating equipment comprises a heating furnace, a quenching unit and a reheating and tempering unit which are arranged consecutively in this order from the entry side.

In some cases, the finishing temperature of the rolling line may be selected suitably so as to eliminate the heating furnace.

Further, the finishing line is so constructed that three of each of the different finishing machines, for example, are arranged on each side of the single-line transfer line and thus the finishing line has a capacity corresponding to three lines. Although this increased number of the respective finishing machines tends to increase the probability of stopping the line due to the trouble of any one of the machines, that is, if one of the three finishing machines of a particular processing function becomes defective and is stopped, the entire line is not stopped but two of each of the finishing machines, for example, are operated to operate the line with the two-line capacity. Thus, the transfer unit is of the transverse transfer type whose feed length or pitch can be changed to 3:1, 2:1 or 1:1 pitch, such as, a walking beam type transfer unit. This type of walking beam is proposed in U.S. patent application No. 295,253, filed on Aug. 24, 1981 by the inventors, etc.

In accordance with the invention, the respective mills, equipment and machines are connected by the very rational transfer paths with the shortest cuts and are also linked in an in-line manner by means of a combination of axial and transverse feeds, and particularly the finishing line comprises a single transverse transfer line integrating its processing functions including the function of pipe end inspection, with the result that the transfer distance of pipe is minimized on the whole, that the space occupied by the installation is minimized, that the tracking of pipes can be effected easily during rolling as well as various other processing operations, that failure of any unit does not lead to the stopping of the whole and allows the continued execution of the processing although it deteriorates the capacity, that the introduced billet is allowed to progress without being detained during the processing operations until it is turned into the final product, thus ensuring a highly efficient operation without any thermal loss and loss of time.

Also, in accordance with the invention the line for as-rolled pipes and the line for pipes to be heat-treated are continuously combined from the rolling line to the final processing finishing line so that there is no possibility of causing any blank or overlapping of the feed pitch due to change-over between the as-rolled pipes and the pipes to be heat-treated in the course of the manufacture, and moreover the provision just after the rolling line of the heat treating equipment for pipes to be heat-treated makes it possible to feed the pipes to the heating furnace while the heat loss is still low with resulting reduction of the energy loss, thus realizing efficient production of seamless steel pipes by the single continuous line.

Embodiments of the invention will now be described with reference to the accompanying drawings.

DESCRIPTION OF THE PREFERRED EMBODIMENTS

Figure 1:
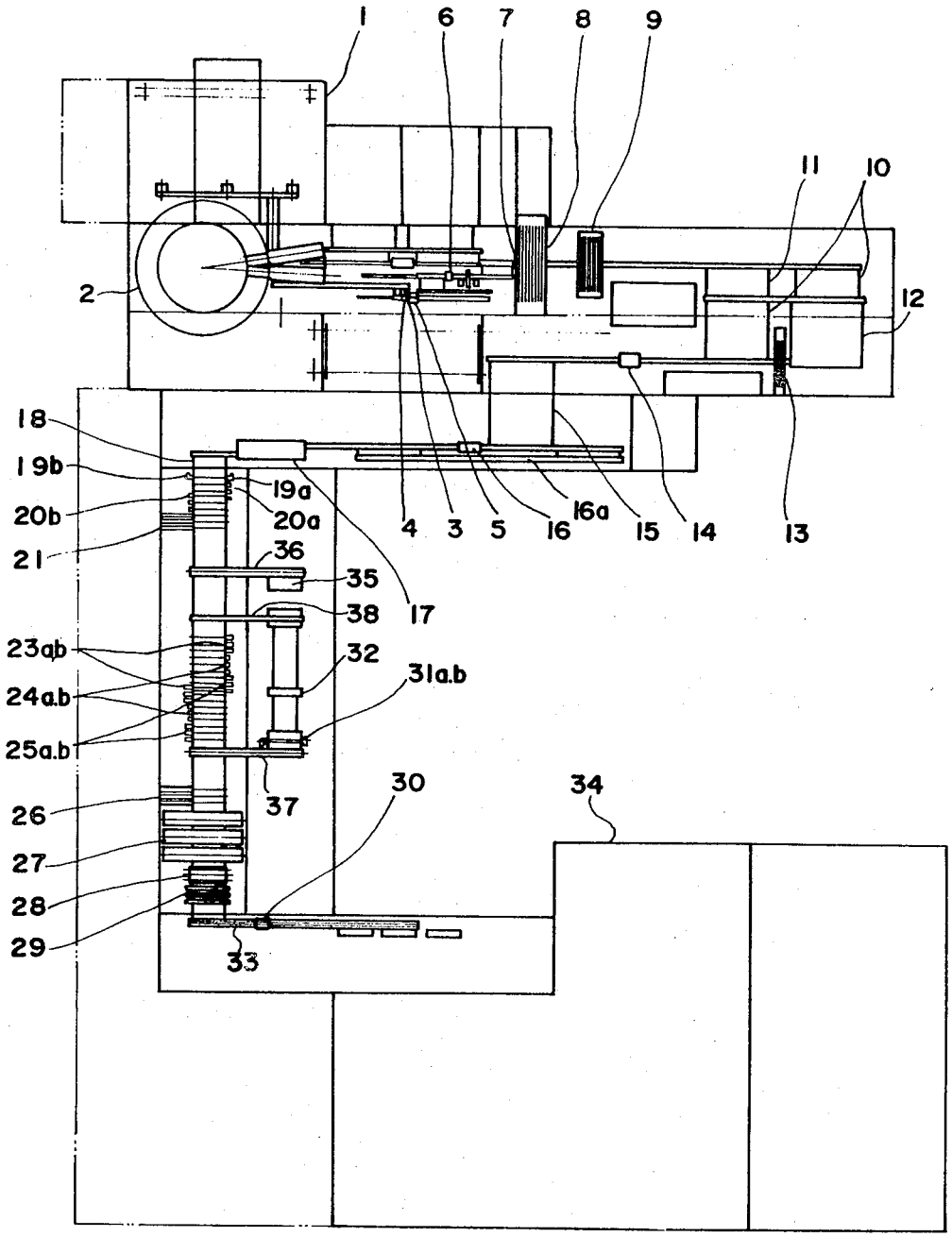
FIG. 1 is a plan view showing the layout of a seamless steel pipe manufacturing installation according to an embodiment of this invention.

FIG. 1 is a plan view showing the overall layout of a seamless steel pipe manufacturing installation according to an embodiment of the invention, in which numeral 1 designates a raw material billet storage yard, and 2 a rotary hearth type heating furnace for soaking the billet. The exit of the heating furnace 2 is connected by way of an axial transfer conveyor to the entry side of a piercing mill 5, and arranged on the entry side of the piercing mill 5 are a descaler 4 and a billet centering machine 3 for centering the billet at a position upstream of the descaler 4. The piercing mill 5 comprises for example a vertical two-roll disk-shoe type Mannesmann Piercer, and the heated billet which was fed axially by the conveyor from the heating furnace 2 is turned sideways and fed at the conveyor terminal end to the centering machine 3 so that after the centering operation the billet is forced out axially by a pressing machine or the like and it is simultaneously gripped by the piercing mill 5 by way of the descaler 4, thus causing the piercing mill 5 to produce a hollow crude pipe or shell. The exit side of the piercing mill 5 is connected to the entry side of an elongator 6 by way of a short transverse transfer table. The elongator 6 comprises for example a bar retract type expander comprising a three-roll assel mill employing a mandrel bar and its exit side is connected as such to a rolling mill 8 by way of a short transverse transfer table. The rolling mill 8 comprises a multiple-stand two-roll continuous rolling mill of the mandrel bar restraining type with a descaler 7 at its entry end and its exit side is directly connected coaxially to a sizer 9.

In this embodiment, the above-mentioned rolling line including from the piercing mill 5 to the sizer 9 is followed by transverse skid type cooling beds 10, a straightener 14, a nondestructive inspection machine 16 and a cutting machine 17 which are consecutively arranged in line with one another to form a line, and connected to the exit side of the cutting machine 17 is a single-line transverse transfer line 18 forming a finishing line which will be described later.

Figure 4:
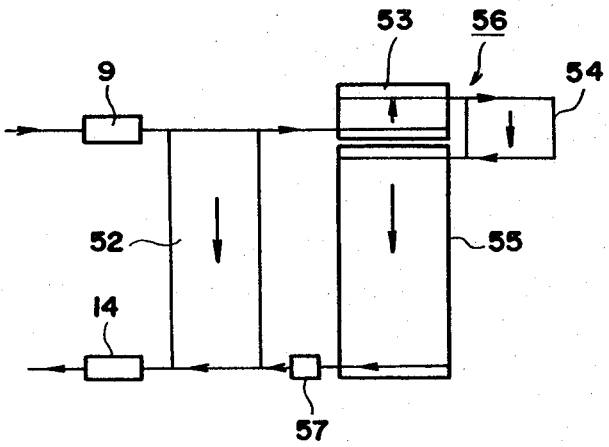
FIG. 4 is a plan view showing in part the layout of cooling equipment and heat treating equipment in accordance with still another embodiment of the invention.

In other words, the exit side of the sizer 9 is connected to the cooling beds 10 by way of the axial feed conveyor. In the embodiment of FIG. 1, two units of the cooling bed 10 are provided, one forming a route which passes through a quenching unit 11 for water cooling the inner and outer pipe surfaces and the other forming a route which passes through a temper furnace 12, and the two units are of the transverse feed type designed so that the substantial transfer times of the units are the same. The exit of the temper furnace 12 is connected to another sizer 13 so that the two routes are joined and then connected via the axial feed conveyor to the roll type straightener 14 combining the function of pipe end straightening. Where the pipe is passed via the route passing through the cooling bed 10 and the quenching unit 10, the rolled steel pipe need not always be quenched, and if it is desired to produce an as-rolled pipe, the rolled pipe is not quenched in the quenching unit 11 but the rolled pipe is simply transferred therethrough. On the other hand, the rolled pipe which was quenched in the quenching unit 11 may be fed to the temper furnace 12. This arrangement of the cooling equipment and the heat treating equipment may be modified as shown in FIGS. 2 and 3 or FIG. 4.

Figure 2:
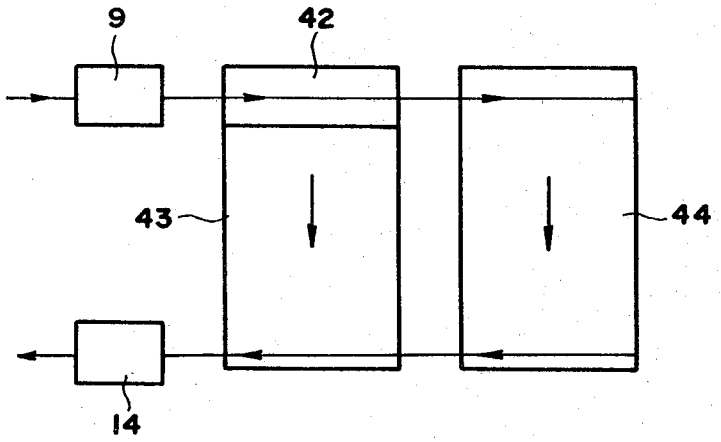
FIG. 2 is a plan view showing in part the layout of a cooling equipment and a heat treating equipment according to another embodiment of the invention.

FIG. 2 is a plan view showing the line arrangement of a principal part of another embodiment of the invention which may be used to replace a part of the layout shown in FIG. 1. Numeral 9 designates the sizer in the rolling line of FIG. 1 and a quenching unit 42 and a cooling equipment 43 are arranged consecutively on the exit side of the sizer 9. Numeral 44 designates a tempering unit arranged parallel to the quenching unit 42 and the cooling equipment 43, and 14 the straightener of FIG. 1. Of the rolled steel pipes emerging from the sizer 9, the as-rolled pipes are not quenched so that they are directly kicked out transversely, passed through the quenching unit 42 without being quenched, fed into the cooling equipment 43 and transferred to the exit side. On the other hand, the pipes requiring heat treatment are quenched in the quenching unit 42, then axially fed into the tempering unit 44 in which the pipes are fed transversely and tempered and are again axially fed at the exit side so as to join the exit side of the cooling equipment 43. Note that the sizer 13 shown in FIG. 1 may be arranged between the tempering unit 44 and the cooling equipment 43 in case of need.

The machines on the exit side of the cooling equipment 43 or downstream of the junction portion are formed into a single-line construction, that is, the pipes are fed via the straightener 14, a final cooling bed 15 and the nondestructive inspection machine 16 which are arranged as shown in FIG. 1 and then fed to the finishing line 18 from the cutting machine 17.

Figure 3:
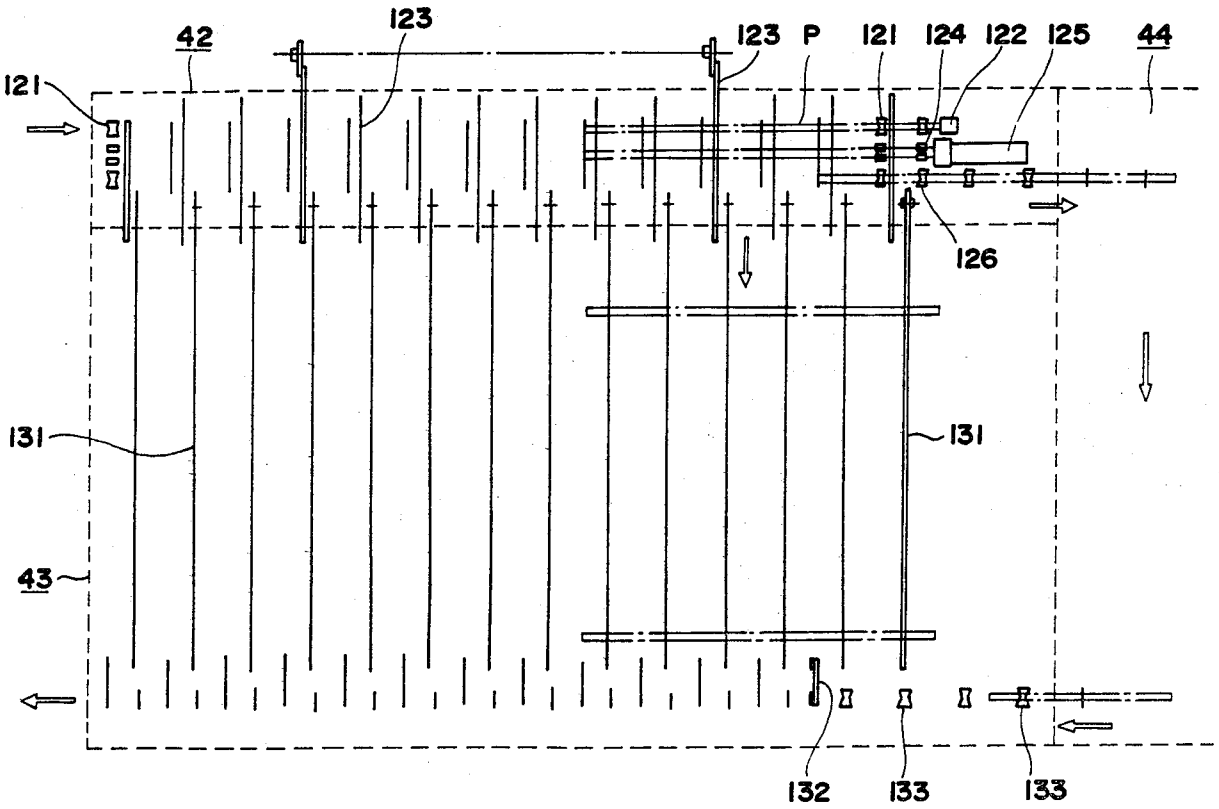
FIG. 3 is a plan view showing in greater detail the layout of a part of FIG. 2.

FIG. 3 is a detailed expanded plan view showing the arrangement of the quenching unit 42 and the cooling equipment 43. A rolled steel pipe P emerging from the sizer 9 is fed axially by transfer rolls 121 so that it strikes against a stopper 122 and stops. If the rolled steel pipe P is an as-rolled pipe, it is fed transversely by a walking beam 123 so that the pipe is transferred onto a transfer unit 131 comprising for example a roller dog chain, fed transversely over the cooling equipment 43, transferred onto transfer rolls 133 by a kick-out mechanism 132 arranged on the exit side of the cooling equipment 43 and then fed axially into the straightener 14.

On the other hand, if the rolled steel pipe P is a pipe to be heat treated, the pipe is transferred by the walking beam 123 onto rolls 124 so that the end of the pipe is clamped by a quenching head 125 and cooling water is sprayed over the inner or both the inner and outer surface of the steel pipe P thus quenching it. When the quenching is completed so that the clamping by the quenching head 125 is released, the steel pipe P is transferred onto transfer rolls 126 by the walking beam 123 and it is then fed axially and charged into the tempering unit 44 in which the pipe is fed transversely and heat-treated. After the tempering has been completed, the steel pipe P is transferred at the entry side onto the transfer rolls 133 so that the pipe is fed axially, joins on the exit side of the cooling equipment 43 and fed into the straightener 14. It is to be noted that the walking beam 123 is designed to vary its feed length or pitch between the as-rolled pipe and the pipe to be heat-treated, and also the transfer unit 131 of the cooling equipment 43 is designed so that its feed time can be set as desired. Note that in the case of pipes to be heat-treated, heating means for compensating variations in the temperature of pipes or ensuring a predetermined quenching temperature may be arranged in the front or back of the sizer 9 in case of need.

FIG. 4 is a plan view showing the line arrangement of a principal part of still another embodiment which may be used to replace a part of the embodiment of FIG. 1 as in the case of FIG. 2. In FIG. 4, directly connected parallel to the exit side of the sizer 9 are a cooling equipment 52 comprising a transverse skid type cooling bed and a heat treating equipment 56 comprising a soaking pit 53, a quenching unit 54 and a reheating furnace 55 which are arranged consecutively, and the speeds of their transfer means are selected so that substantially the same time is required for the pipe to pass through the cooling equipment 52 and the heat treating equipment 56, respectively. More specifically, the rolled steel pipes emerging from the sizer 9 are sorted such that those for as-rolled pipes are kicked out onto the cooling equipment 52, and the pipes to be heat-treated are fed into the heating furnace 53 so that the pipes are subjected to the required heat treatment and are then passed again to join at the exit side of another sizer 57 in case of need. The time required for the pipe for as-rolled product to pass from the entry of the cooling equipment 52 to its exit is the same with the time required for the pipe to be heat-treated to pass from the entry of the heat treating equipment 56 to its exit. As a result, considering the problem of joining at the exit side of the cooling equipment 52, if the rolled steel pipes emerging at equal intervals from the rolling line are switched from the processing for as-rolled product to the processing for heat-treated product at a given time, there is no danger of the feed pitch of the transferred steel pipes being blanked or overlapped at the joining point and the continuous transfer of the pipes at the equally spaced pitch is still ensured. The section downstream of the joining section is connected in the same manner as in the case of FIG. 2 to the single line including the straightener 14, etc., as shown in FIG. 1.

Referring again to FIG. 1, the ultrasonic nondestructive inspection machine 16 is arranged on the exit side of the straightener 14 via the final cooling bed 15, and the inspection machine 16 continuously and nondestructively inspects the entire length of the steel pipe for the presence of defects. The entry and exit of the inspection machine 16 are connected by a return path by means of a bypass conveyor **16*a* for the purpose of reinspection. The exit side of the inspection machine 16 is directly connected to the high-speed tandem type cutting machine 17 by way of the axial feed conveyor and the exit of the cutting machine 17 is connected to the entry of the transverse transfer line 18. The transverse transfer line 18 is of the variable feed pitch type comprising for example a high-speed walking beam. As shown in enlarged form in FIG. 5, downstream of a pair of pipe end cut-off machines 19*a* and 19*b* arranged on the sides of the line 18 near its entry, a plurality (3** in the Figure) of each of various finishing and inspection machines are arranged on each side of the line so that the line is allowed to give full play to its capacity corresponding to a plurality of lines and also the feed pitch of the walking beam can be changed for example to 3:1, 2:1 or 1:1 pitch depending on the number of units of each of the finishing and inspection machines in operation, thus allowing the performance of all the finishing operations by the single line and also allowing the finishing line to operate with a capacity that matches to the capacity of the rolling line.

Figure 5:
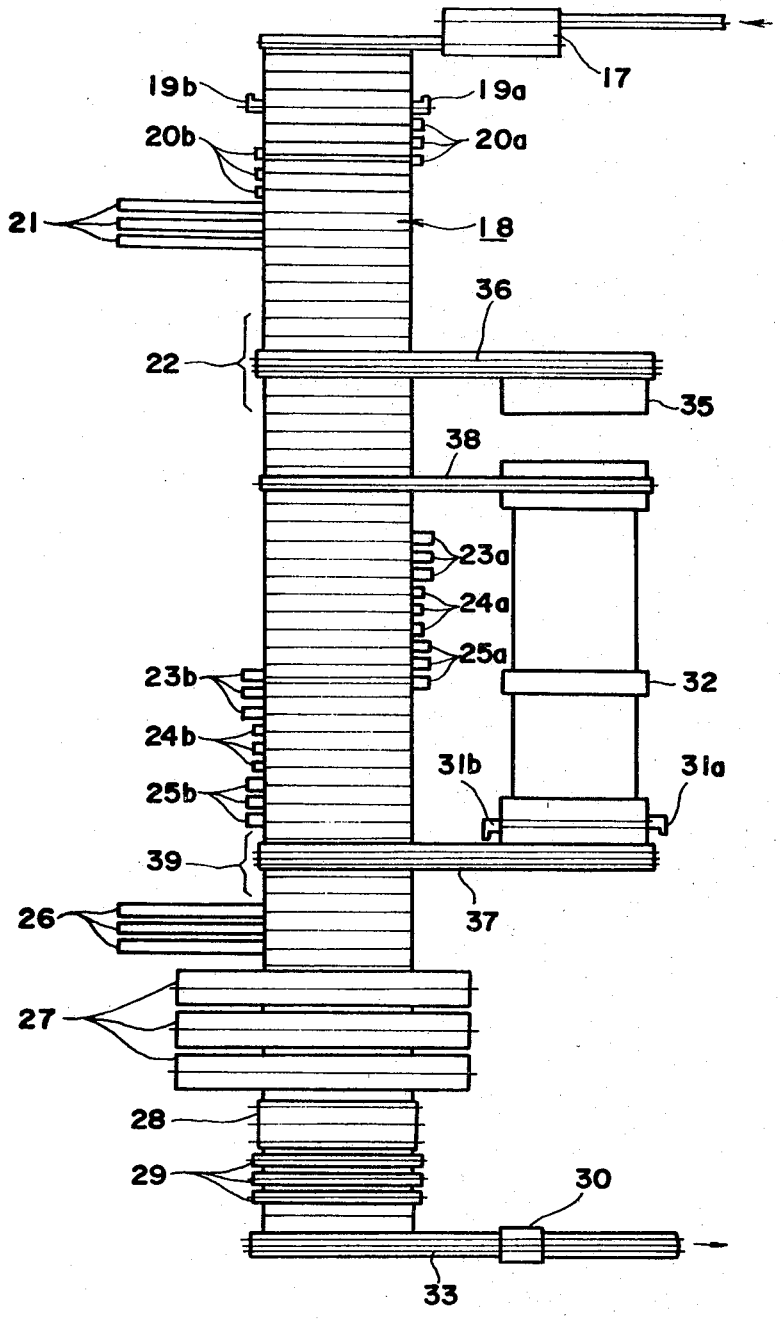
FIG. 5 is a plan view showing in enlarged form the layout of an embodiment of a finishing line.

More specifically, in FIG. 5 numerals 20*a* and 20*b* each designates three pipe end chamfering machines including three heads on each side, and 21 three pipe inner surface cleaners. Arranged downstream of the cleaners 21 via an inspection table 22 are three heads each of pipe end threading machines 23*a* and 23*b*, thread inspection machines 24*a* and 24*b* and machines 25*a* and 25*b* for fitting threaded components such as pipe end protectors or couplings and these machines are consecutively arranged on the sides of the line. Bridged between the entry and exit ends of this continuous section is a transfer unit including a transfer car 32 and pipe end recutters 31*a* and 31*b* for defectively threaded pipes. Further arranged consecutively downstream of the threaded component fitting machines 25*a* and 25*b* are three drift power tighteners 26 for threading or screwing pipe end sealing cups, three hydrostatic testers 27, three measuring and weighing machines 28 and three marking machines 29 and this section extends up to exit of the transfer line 18. The exit end of the line 18 is connected by way of a three-way conveyor 33 to a product yard 34 with three coating machines 30 being interposed. Thus, a continuous integral line construction extending from the billet yard 1 to the product yard 34 is provided.

More specifically, the above-mentioned variable feed pitch transverse transfer system comprises a plurality of sections which are divided and provided between the entry and exit ends of the transfer line 18. In other words, provided between the entry end and the pipe end cut-off machines 19*a* and 19*b* is a section where the pipes are received at a constant pitch and are transversely transferred at a 1:1 pitch, and then a first variable feed pitch section is provided between before the pipe end chamfering machines 20*a* and the end of the pipe inner surface cleaners 21. The following inspection table 22 may feed the pipe at the 1:1 pitch or the variable pitch. Extended sideways from the middle of the inspection table 22 is an axial feed conveyor 36 whereby any pipe determined as having defective pipe end chamfer by the inspection is transferred to a rechamfering table 35 which is outside the line and the rechamfered pipe is returned to the line. Further on the downstream side, a second variable feed pitch transverse transfer section is provided between before the threading machines 23*a* and the end of the threaded component fitting machines 25*b*, and arranged downstream of this section is another inspection table 39 so that any pipes which are detected as defectively threaded pipes or pipes which are not fitted properly with threaded components by the inspection machines 24*a* and 24*b* will be transferred to the outside of the line by a conveyor 37. An off-line recut-off operation line is connected to the entry and exit ends of the second variable feed pitch section so that the ends of the pipes including the defective threads or the like are cut off again as an off-line operation by a pair of pipe end cut-off machines 31*a* and 31*b* and are transferred by the transfer car 32 to a conveyor 38 upstream of the threading machines 23*a*, thus returning the pipes to the sequential operation such as the thread cutting operation. The inspection tables 22 and 39 function as buffer sections for the respective variable feed pitch sections so that the blanks caused in the row of pipes by the extraction of defective pipes or the like is compensated for and also smooth transfer of the row of pipes at the connection between the sections is ensured.

A third variable feed pitch transverse feed section is provided downstream of the inspection table 39 and between the drift power tightener 26 and the end of the marking machines 29, and provided at the exit downstream of this variable feed pitch section are the plurality of axial feed conveyors 33 leading to the product yard. The coating machines 30 are arranged midway on the conveyors 33. In each of these variable feed pitch transverse feed sections, if all three of the respective finishing machines are operating properly, the pipes are transferred simultaneously each over a transfer distance corresponding to the 3:1 pitch. If one of three of any machine group is stopped by any trouble, the pipes are transferred simultaneously each over a distance corresponding to the 2:1 pitch and the finishing operations are performed with the two third capacity. If two of the three units are stopped, the pipes are transferred simultaneously each over a distance corresponding to the 1:1 pitch and the finishing operations are performed with the one third capacity. Of course, the number of units of the respective finishing machines is not limited to 3 and the number may have any desired value provided that the respective machine groups are the same in number. In this case, it is only necessary to arrange so that the pipes are transversely fed according to the number of pitches corresponding to the number. Thus, it is possible to prevent complete stoppage of the line due to the trouble of any finishing machine and there is no need to stop the line during the maintenance of the machines or during the tool changing operation.

What is claimed is:

1. A manufacturing line for the manufacture of seamless steel pipes as-rolled or heat treated, including a serially arranged heating section, a preliminary treatment section, cooling and heat treating section, straightening and inspection section, and finishing section, said manufacturing line comprising:

means for heating raw material billets;

a preliminary treatment section including a piercing machine, an elongator, a multistand continuous pipe rolling mill, and a sizer which are arranged serially in that order;

a cooling and heat treating section whereby rolled pipes fed thereinto in the axial direction from said rolling line are selectively cooled or heat treated while being transferred transversely, said section including a cooling station and a heat treating station connected in parallel with said cooling station, and means to selectively feed rolled pipes to one of said cooling station and said heating station to selectively provide as-rolled pipes and heat treated pipes, and transfer means to selectively transversely transfer rolled pipes through said cooling section and through said heat treating section at an equal transfer time;

a straightening and inspection section including a straightening machine for straighting pipes from said cooling and heat treating section while the pipes are being transferred in the axial direction, an inspection machine for subjecting pipes from said straightening machine to nondestructive inspection while the pipes are being transferred in the axial direction, and a cutting machine for cutting pipes from said inspection machine in predetermined lengths while the pipes are being transferred in the axial direction, and are arranged in series subsequently to said rolling line;

a finishing section including a continuous transverse transfer line connected to the exit side of the cutting machine and a plurality of types of finishing machines each of a plural number such as pipe end chamfering machines, pipe inner surface cleaners, pipe end threading machines, thread inspection machines, threaded component fitting machines, drift power tighteners, hydrostatic testing machines, measuring and weighing machines, marking machines and coating machines arranged along said transverse transfer line each in a number according to the respective rolling capacity;

said continuous transverse transfer line and subsequent finishing machines arranged between said straightening machine and the exit side of said finishing line and utilized in common for as-rolled pipes and pipes to be heat-treated.

2. An installatin according to claim 1, wherein a quenching section is arranged on the entry side of said cooling section and is connected to said rolling line on the downstream side thereof.

3. An installation according to claim 1, wherein a quenching section is arranged on the entry side of said cooling section and is connected to said rolling line on the downstream side thereof, and wherein a tempering section is arranged parallel to said cooling section.

4. An installation according to claim 1, wherein said transverse transfer line of said finishing line for performing pipe end finishing operations on the ends of steel pipes comprises a single line extending from the entry end to the exit end thereof and having a pipe feed pitch variable to a plurality of values, wherein each of said groups of finishing machines includes the same number of units of the same processing function, said number being less than the maximum number of feed pitches of said transfer line, and wherein said groups of finishing machines are arranged one after another along said transfer line in accordance with a predetermined sequence of processing operations.

5. An installation according to claim 1, wherein said cooling section downstream of said rolling line is a cooling section for as-rolled pipes, and wherein a heat treating section for pipes to be heat-treated is connected in parallel to said cooling section in such a manner that the same transfer time is required to pass a rolled steel pipe through each of said two sections, thereby permitting the outlets of said two sections to feed into a single-line section such that the following processing and inspection machines arranged between said straightening machine and the entry end of said conditioning line are utilized in common by as-rolled pipes and pipes to be heat-treated.

6. An installation according to claim 5, wherein said heat treating section comprises a quenching unit and a tempering unit which are consecutively arranged in that order from the entry end of said heat treating section.

7. An installation according to claim 5, wherein said heat treating section comprises a heating furnace, a quenching unit and a tempering unit which are arranged consecutively in that order from the entry end of said heat treating section.

8. A manufacturing line according to claim 1, wherein the transverse transfer line has a pipe feed pitch variable to a plurality of values and wherein the number of the finishing machines is equal to or less than the maximum number of said pitches for each processing function, the groups of said finishing machines being arranged one after another along said finishing line in accordance with a predetermined sequence of finishing processes.

* * * * *